US007354527B2

(12) United States Patent
Tano et al.

(10) Patent No.: US 7,354,527 B2
(45) Date of Patent: Apr. 8, 2008

(54) CHEMICAL MECHANICAL POLISHING PAD AND CHEMICAL MECHANICAL POLISHING PROCESS

(75) Inventors: Hiroyuki Tano, Chuo-ku (JP); Hideki Nishimura, Chuo-ku (JP); Hiroshi Shiho, Chuo-ku (JP)

(73) Assignee: JSR Corporation, Tokyo (JP)

( * ) Notice: Subject to any disclaimer, the term of this patent is extended or adjusted under 35 U.S.C. 154(b) by 0 days.

(21) Appl. No.: 11/219,843

(22) Filed: Sep. 7, 2005

(65) Prior Publication Data

US 2006/0060569 A1 Mar. 23, 2006

(30) Foreign Application Priority Data

Sep. 17, 2004 (JP) ..... 2004-271677

(51) Int. Cl.
*B44C 1/22* (2006.01)

(52) U.S. Cl. ..... 216/88; 216/91; 438/626; 438/692; 438/697; 451/527; 451/533; 451/539; 451/548; 451/550

(58) Field of Classification Search ..... 216/88; 438/692; 451/527
See application file for complete search history.

(56) References Cited

U.S. PATENT DOCUMENTS

| | | | | |
|---|---|---|---|---|
| 5,976,000 | A | 11/1999 | Hudson | |
| 6,454,634 | B1 * | 9/2002 | James et al. | 451/41 |
| 6,992,123 | B2 * | 1/2006 | Shiho et al. | 524/17 |
| 2005/0055885 | A1 * | 3/2005 | Obeng | 51/293 |

FOREIGN PATENT DOCUMENTS

| | | |
|---|---|---|
| EP | 1 354 913 A1 | 10/2003 |
| JP | 8-500622 | 1/1996 |
| JP | 8-39423 | 2/1996 |
| JP | 8-216029 | 8/1996 |
| JP | 11-70463 | 3/1999 |
| JP | 2000-33552 | 2/2000 |
| JP | 2000-34416 | 2/2000 |
| JP | 2001-334455 | 12/2001 |
| JP | 2002-36097 | 2/2002 |

OTHER PUBLICATIONS

Patent Abstracts of Japan, JP 2004-189846, Jul. 8, 2004.
Patent Abstracts of Japan, JP 2004-167680, Jun. 17, 2004.
Patent Abstracts of Japan, JP 2004-165408, Jun. 10, 2004.

* cited by examiner

*Primary Examiner*—Nadine Norton
*Assistant Examiner*—Maki Angadi
(74) *Attorney, Agent, or Firm*—Oblon, Spivak, McClelland, Maier & Neustadt, P.C.

(57) ABSTRACT

A chemical mechanical polishing pad which has a storage elastic modulus E'(30° C.) at 30° C. of 120 MPa or less and an (E'(30° C.)/E'(60° C.)) ratio of the storage elastic modulus E'(30° C.) at 30° C. to the storage elastic modulus E'(60° C.) at 60° C. of 2.5 or more when the storage elastic moduli of a polishing substrate at 30° C. and 60° C. are measured under the following conditions:

initial load: 100 g
maximum bias: 0.01 %
frequency: 0.2 Hz.

A chemical mechanical polishing process makes use of the above chemical mechanical polishing pad. The chemical mechanical polishing pad can suppress the production of a scratch on the polished surface in the chemical mechanical polishing step and can provide a high-quality polished surface, and the chemical mechanical polishing process provides a high-quality polished surface by using the chemical mechanical polishing pad.

20 Claims, No Drawings

CHEMICAL MECHANICAL POLISHING PAD AND CHEMICAL MECHANICAL POLISHING PROCESS

FIELD OF THE INVENTION

The present invention relates to a chemical mechanical polishing pad and a chemical mechanical polishing process.

DESCRIPTION OF THE PRIOR ART

In the manufacture of a semiconductor device, chemical mechanical polishing (generally abbreviated as CMP) is attracting much attention as a polishing technique capable of forming an extremely flat surface for a silicon substrate or a silicon substrate having wiring or electrodes formed thereon (to be referred to as "semiconductor wafer" hereinafter). Chemical mechanical polishing is a technique for polishing by letting an aqueous dispersion for chemical mechanical polishing (an aqueous dispersion of abrasive grains) flow down over the surface of a chemical mechanical polishing pad while the polishing pad and the surface to be polished of an object are brought into slide contact with each other. It is known that the polishing result is greatly affected by the shape and properties of the chemical mechanical polishing pad in this chemical mechanical polishing, and there have been proposed various chemical mechanical polishing pads.

For example, a chemical mechanical polishing pad which is made of foamed polyurethane containing tiny cells and used to polish by holding an aqueous dispersion for chemical mechanical polishing in holes (to be referred to as "pores" hereinafter) open to the surface of the pad has been known for a long time (refer to JP-A 11-70463, JP-A 8-216029 and JP-A 8-39423) (the term "JP-A" as used herein means an "unexamined published Japanese patent application").

Recently, a polishing pad containing a water-soluble polymer dispersed in a matrix resin has been disclosed as a polishing pad capable of forming pores without using foam (JP-A 8-500622, JP-A 2000-34416, JP-A 2000-33552 and JP-A 2001-334455). In this technology, pores are formed by the dissolution of the water-soluble polymer dispersed into the matrix resin upon its contact with an aqueous dispersion or water for chemical mechanical polishing at the time of polishing.

In the chemical mechanical polishing of the surface to be polished, when abrasive grains contained in the aqueous dispersion for chemical mechanical polishing in use agglomerate into a coarse grain, it acts as foreign matter to cause a defect called "scratch" on the surface. It is desired to improve this. A scratch is also produced when the composition of the polishing pad is hard or when abrasive grains agglomerate and the composition of the polishing pad is hard. It is also desired to improve this.

To solve the above problem, there is proposed a multi-layer pad comprising a soft buffer layer on the rear surface (non-polishing surface) of a pad (refer to JP-A 2002-36097). However, the above multi-layer pad improves the above problem to some extent but does not solve it completely. It is known that its production process is complicated, thereby boosting costs and causing a quality control problem.

Meanwhile, with a view to improving the performance of a semiconductor device, use of an insulating film having a lower dielectric constant in place of the conventional insulating film ($SiO_2$ film) is attracting attention. As this low-dielectric insulating film, for example, silsesquioxane (dielectric constant; about 2.6 to 3.0), fluorine added $SiO_2$ (dielectric constant; about 3.3 to 3.5), polyimide-based resin (dielectric constant; about 2.4 to 3.6, PIQ (trade name) of Hitachi Chemical Co., Ltd., FLARE (trade name) of Allied Signal Co., Ltd.), benzocyclobutene (dielectric constant; about 2.7, BCB (trade name) of Dow Chemical Co., Ltd.), hydrogen-containing SOG (dielectric constant; about 2.5 to 3.5) and organic SOG (dielectric constant; about 2.9, HSGR7 (trade name) of Hitachi Chemical Co., Ltd.) insulating films have been developed up till now. However, as these insulating films have lower mechanical strength and are softer and more fragile than the $SiO_2$ film, when chemical mechanical polishing is carried out by using the conventionally known chemical mechanical polishing pad, more scratches are readily produced than when the conventionally known insulating film is polished, and peeling occurs at the interface between the low-dielectric insulating film which is the surface to be polished and the underlying layer.

When the chemical mechanical polishing of an object coated by depositing a metal as a wiring material on the entire surface of a semiconductor substrate having a low-dielectric insulating film like the above, a groove and a barrier metal film is carried out, the peeling of the underlying low-dielectric insulating film may occur at the interface with the overlying or underlying layer in the stage where the low-dielectric insulating film is not exposed to the surface to be polished, that is, the chemical mechanical polishing of only the metal as the wiring material is carried out.

SUMMARY OF THE INVENTION

It is an object of the present invention which has solved the above problem to provide a chemical mechanical polishing pad which can suppress the production of a scratch on the polished surface of an object and the peeling of a low-dielectric insulating film in the chemical mechanical polishing step and can provide a high-quality polished surface as well as a chemical mechanical polishing process which provides a high-quality polished surface by using the above chemical mechanical polishing pad.

According to the present invention, firstly, the above object of the present invention is attained by a chemical mechanical polishing pad which has a storage elastic modulus E'(30° C.) at 30° C. of 120 MPa or less and an (E'(30° C.)/E'(60° C.)) ratio of the storage elastic modulus E'(30° C.) at 30° C. to the storage elastic modulus E'(60° C.) at 60° C. of 2.5 or more when the storage elastic moduli of a polishing substrate at 30° C. and 60° C. are measured under the following conditions:

initial load: 100 g
maximum bias: 0.01%
frequency: 0.2 Hz.

Secondly, the above object of the present invention is attained by a chemical mechanical polishing process for carrying out chemical mechanical polishing by using the above chemical mechanical polishing pad.

DETAILED DESCRIPTION OF THE PREFERRED EMBODIMENTS

The chemical mechanical polishing pad of the present invention comprises at least a polishing substrate and has a storage elastic modulus E'(30° C.) at 30° C. of 120 MPa or less and an (E'(30° C.)/E'(60° C.)) ratio of the storage elastic modulus E'(30° C.) at 30° C. to the storage elastic modulus E'(60° C.) at 60° C. of 2.5 or more when the storage elastic moduli of the polishing substrate at 30° C. and 60° C. are measured under the following conditions:
initial load: 100 g
maximum bias: 0.01%
frequency: 0.2 Hz.

The storage elastic modulus E'(30° C.) at 30° C. is preferably 30 to 120 MPa and the (E'(30° C.)/E'(60° C.) ratio of the storage elastic modulus E'(30° C.) at 30° C. to the storage elastic modulus E'(60° C.) at 60° C. is preferably 2.5 to 10. The storage elastic modulus E'(60° C.) at 60° C. is preferably 3 to 48 MPa.

The polishing substrate of the chemical mechanical polishing pad of the present invention preferably has a Shore D hardness of 35 or more. This Shore D hardness is more preferably 35 to 100, most preferably 35 to 70. By setting the Shore D hardness to this range, the load pressure on the object to be polished can be made large, thereby making it possible to improve the polishing rate.

The polishing substrate of the chemical mechanical polishing pad of the present invention may be made of any material if it satisfies the above requirements and can serve as a chemical mechanical polishing pad. Out of the functions of the chemical mechanical polishing pad, pores (fine holes) having the functions of holding an aqueous dispersion for chemical mechanical polishing during chemical mechanical polishing and retaining fragments after polishing temporarily are preferably formed by the time of polishing. Therefore, the polishing substrate is preferably composed of (I) a material comprising a water-insoluble member and water-soluble particles dispersed in the water-insoluble member or (II) a material comprising a water-insoluble member and pores dispersed in the water-insoluble member.

In the above material (I) out of the above materials, the aqueous dispersion for chemical mechanical polishing can be held in pores formed in the water-insoluble member by the water-soluble particles which dissolve or swell upon their contact with the aqueous dispersion for chemical mechanical polishing to be eliminated in the chemical mechanical polishing step. Meanwhile, in the material (II), portions formed as the pores have the ability of holding the aqueous dispersion for chemical mechanical polishing.

A detailed description is subsequently given of these materials.

(I) Material Comprising a Water-Insoluble Member and Water-Soluble Particles Dispersed in the Water-Insoluble Member (A) Water-Insoluble Member The material constituting the water-insoluble member (A) is not particularly limited but an organic material is preferably used because it is easily molded to have a predetermined shape and predetermined properties and can provide suitable hardness and suitable elasticity. The organic material is, for example, a thermoplastic resin, elastomer or crude rubber, or curable resin.

Examples of the above thermoplastic resin include olefin-based resins (such as polyethylene and polypropylene), styrene-based resins (such as polystyrene), acrylic resins (such as (meth)acrylate-based resins), vinyl ester resins (excluding (meth)acrylate-based resins), polyester resins (excluding vinyl ester resins), polyamide resins, fluororesin, polycarbonate resins and polyacetal resins.

Examples of the above elastomer or crude rubber include diene-based elastomers (such as 1,2-polybutadiene), olefin-based elastomers (such as dynamically crosslinked products of ethylene-propylene rubber and polypropylene resin), urethane-based elastomers, urethane-based rubbers (such as urethane rubber), styrene-based elastomers (such as styrene-butadiene-styrene block copolymer (may be referred to as "SBS" hereinafter) and hydrogenated product thereof (may be referred to as "SEBS" hereinafter)), conjugated diene-based rubbers (such as high-cis butadiene rubber, low-cis butadiene rubber, isoprene rubber, styrene-butadiene rubber, styrene-isoprene rubber, acrylonitrile-butadiene rubber and chloroprene rubber), ethylene-α-olefin rubbers (such as ethylene-propylene rubber, ethylene-propylene-non-conjugated diene rubber), butyl rubber and other rubbers (such as silicone rubber, fluorine rubber, nitrile rubber, chlorosulfonated polyethylene, acrylic rubber, epichlorohydrin rubber and polysulfide rubber). Examples of the above curable resin include thermosetting resins and photocurable resins such as urethane resins, epoxy resins, unsaturated polyester resins, polyurethane-urea resins, urea resins, silicon resins and phenolic resins.

These organic materials may be used alone or in combination of two or more.

These organic materials may be modified to have a suitable functional group. Examples of the suitable functional group include a group having an acid anhydride structure, carboxyl group, hydroxyl group, epoxy group and amino group.

Preferably, the organic material is partially or wholly crosslinked. When the water-insoluble member contains a crosslinked organic material, suitable elastic recovery force is provided to the water-insoluble member and displacement caused by shear stress applied to the chemical mechanical polishing pad during chemical mechanical polishing can be suppressed. Further, it is possible to effectively prevent the pores from being filled by the plastic deformation of the water-insoluble member when it is excessively stretched in the chemical mechanical polishing step or at the time of dressing (dressing of the chemical mechanical polishing pad which is carried out alternately or simultaneously with chemical mechanical polishing) and the surface of the chemical mechanical polishing pad from being excessively fluffed. Therefore, a chemical mechanical polishing pad which enables pores to be efficiently formed even at the time of dressing, can prevent a drop in the ability of holding the aqueous dispersion for chemical mechanical polishing during polishing, is rarely fluffed and can retain polishing flatness for a long period of time can be obtained.

The above crosslinked organic material contains preferably at least one selected from the group consisting of a crosslinked thermoplastic resin and crosslinked elastomer or crosslinked rubber ("crosslinked rubber" as used herein means crosslinked product of the above "crude rubber"), more preferably at least one selected from the group consisting of a crosslinked diene-based elastomer, crosslinked styrene-based elastomer and crosslinked conjugated diene-based rubber, much more preferably at least one selected from the group consisting of crosslinked 1,2-polybutadiene, crosslinked SBS, crosslinked SEBS, crosslinked styrene butadiene rubber, crosslinked styrene-isoprene rubber and crosslinked acrylonitrile-butadiene rubber, particularly preferably at least one selected from the group consisting of crosslinked 1,2-polybutadiene, crosslinked SBS and crosslinked SEBS.

When part of the organic material is crosslinked and the rest is not crosslinked, the non-crosslinked organic material contains preferably at least one selected from the group consisting of a non-crosslinked thermoplastic resin and non-crosslinked elastomer or crude rubber, more preferably at least one selected from the group consisting of a non-crosslinked olefin-based resin, non-crosslinked styrene-based resin, non-crosslinked diene-based elastomer, non-crosslinked styrene-based elastomer, non-crosslinked conjugated diene-based rubber and non-crosslinked butyl rubber, much more preferably at least one selected from the group consisting of non-crosslinked polystyrene, non-crosslinked 1,2-polybutadiene, non-crosslinked SBS, non-crosslinked SEBS, non-crosslinked styrene-butadiene rubber, non-crosslinked styrene-isoprene rubber and non-crosslinked acrylonitrile-butadiene rubber, particularly preferably at least one selected from the group consisting of non-crosslinked polystyrene, non-crosslinked 1,2-polybutadiene, non-crosslinked SBS and non-crosslinked SEBS.

When part of the organic material is crosslinked and the rest is non-crosslinked, the amount of the crosslinked organic material in the water-insoluble member is preferably 30% or more by mass, more preferably 50% or more by mass, particularly preferably 70% or more by mass.

When the organic material is partially or wholly crosslinked, crosslinking is not particularly limited but preferably chemical crosslinking, radiation crosslinking or optical crosslinking. The above chemical crosslinking can be carried out by using an organic peroxide, sulfur or sulfur compound as a crosslinking agent. The above radiation crosslinking can be carried out by the application of an electron beam. The above optical crosslinking can be carried out by the application of ultraviolet radiation.

Out of these, chemical crosslinking is preferred, and an organic peroxide is preferably used because it is easy to handle and does not contaminate the object to be polished in the chemical mechanical polishing step. Examples of the organic peroxide include dicumyl peroxide, diethyl peroxide, di-t-butyl peroxide, diacetyl peroxide and diacyl peroxide.

In the case of chemical crosslinking, the amount of the crosslinking agent is preferably 0.01 to 0.6 part by mass based on 100 parts by mass of the water-insoluble member to be subjected to a crosslinking reaction. When the amount of the crosslinking agent falls within the above range, a chemical mechanical polishing pad which suppresses the production of a scratch in the chemical mechanical polishing step can be obtained.

The material constituting the water-insoluble member may be wholly crosslinked, or part of the material constituting the water-insoluble member may be crosslinked and then mixed with the rest. Several crosslinked products by each different method may be mixed together.

Further, an organic material having a crosslinked portion and a non-crosslinked portion can be easily obtained with one time of crosslinking operation by adjusting the amount of a crosslinking agent and crosslinking conditions in the case of chemical crosslinking or controlling the dose of radiation in the case of radiation crosslinking.

The water-insoluble member (A) may contain a suitable compatibilizing agent to control its compatibility with the water-soluble particles (B) which will be described hereinafter and the dispersibility of the water-soluble particles (B) in the water-insoluble member. The compatibilizing agent is, for example, a nonionic surfactant or coupling agent.

(B) Water-Soluble Particles

The water-soluble particles (B) have the function of forming pores in the water-insoluble member when they come into contact with the aqueous dispersion for chemical mechanical polishing to be eliminated from the water-insoluble member in the chemical mechanical polishing pad and also the function of increasing the indentation hardness of the polishing substrate of the chemical mechanical polishing pad and provides the above Shore D hardness to the polishing substrate.

The above elimination is caused by dissolution or swelling upon contact with water or an aqueous mixed medium contained in the aqueous dispersion for chemical mechanical polishing.

The water-soluble particles (B) are preferably solid to ensure the indentation hardness of the polishing substrate of the above chemical mechanical polishing pad. Therefore, the water-soluble particles are particularly preferably solid to ensure sufficiently high indentation hardness in the chemical mechanical polishing pad.

The material constituting the water-soluble particles (B) is not particularly limited but may be organic water-soluble particles or inorganic water-soluble particles. Examples of the above organic water-soluble particles include saccharides (polysaccharides (such as starch, dextrin and cyclodextrin), lactose, and mannitol)), celluloses (such as hydroxypropyl cellulose and methyl cellulose), protein, polyvinyl alcohol, polyvinyl pyrrolidone, polyacrylic acid, polyethylene oxide, water-soluble photosensitive resins, sulfonated polyisoprene and sulfonated polyisoprene copolymer. Examples of the above inorganic water-soluble particles include potassium acetate, potassium nitrate, potassium carbonate, potassium bicarbonate, potassium chloride, potassium bromide, potassium phosphate and magnesium nitrate. Out of these, organic water-soluble particles are preferred, polysaccharides are more preferred, cyclodextrin is much more preferred, and β-cyclodextrin is particularly preferred.

The above materials may be used alone or in combination of two or more to form the water-soluble particles. Further, they may be made of one predetermined material or a combination of two or more different materials.

The average particle diameter of the water-soluble particles (B) is preferably 0.1 to 500 μm, more preferably 0.5 to 100 μm. When the water-soluble particles (B) have the above particle diameter range, the size of the pores formed by the elimination of the water-soluble particles (B) can be controlled to a suitable range, thereby making it possible to obtain a chemical mechanical polishing pad which is excellent in the ability of holding the aqueous dispersion for chemical mechanical polishing and polishing rate in the chemical mechanical polishing step as well as mechanical strength.

The amount of the water-soluble particles (B) is preferably 1 to 90% by volume, more preferably 1 to 60% by volume, particularly preferably 3 to 40% by volume based on the total of the water-insoluble member (A) and the water-soluble particles (B). When the amount of the water-soluble particles (B) falls within the above range, a chemical mechanical polishing pad having good balance between mechanical strength and polishing rate can be obtained.

Preferably, the above water-soluble particles (B) dissolve in water or swell with water to be eliminated only when it is exposed to the surface layer in contact with the aqueous dispersion for chemical mechanical polishing in the chemical mechanical polishing pad and does not absorb moisture in the inside of the polishing substrate. Therefore, the water-soluble particles (B) may have an outer shell for suppressing moisture absorption on at least part of its outermost portion. This outer shell may be physically adsorbed to the water-soluble particle, chemically bonded to the water-soluble particle, or adhered to the water-soluble particle physically and chemically. The material for forming this outer shell is an epoxy resin, polyimide, polyamide or polysilicate.

(II) Material Composed of a Water-Insoluble Member and Pores Dispersed in the Water-Insoluble Member When the polishing substrate of the chemical mechanical polishing pad of the present invention is composed of a water-insoluble member and pores dispersed in the water-insoluble member, the material of the polishing substrate is foamed polyurethane, melamine resin, polyester, polysulfone or polyvinyl acetate.

The average diameter of the pores dispersed in the above water-insoluble member is preferably 0.1 to 500 μm, more preferably 0.5 to 100 μm.

The shape of the polishing substrate of the chemical mechanical polishing pad of the present invention is not particularly limited but may be disk-like or polygonal pole-like. It may be suitably selected according to a polishing machine to be used with the chemical mechanical polishing pad of the present invention.

The size of the polishing substrate is not particularly limited. In the case of a disk-like chemical mechanical polishing pad, the polishing substrate has a diameter of 150 to 1,200 mm, specifically 500 to 800 mm, and a thickness of 1.0 to 5.0 mm, specifically 1.5 to 3.0 mm.

The polishing substrate of the chemical mechanical polishing pad of the present invention may have a groove(s) on the polishing surface. The groove(s) hold(s) the aqueous dispersion for chemical mechanical polishing to be supplied at the time of chemical mechanical polishing, uniformly distribute(s) it to the polishing surface, temporarily retain(s) wastes such as fragments after polishing and the used aqueous dispersion, and serve(s) as a path for discharging them to the outside.

The shape of the above groove(s) is not particularly limited but may be spiral, concentric or radial.

The polishing substrate of the chemical mechanical polishing pad of the present invention may have a recess(es) on the non-polishing surface (rear surface). The recess(es) has/have the function of alleviating local excessive strain which may be generated during chemical mechanical polishing and the function of effectively suppressing the production of a surface defect such as a scratch on the polished surface.

The shape of the above recess(es) is not particularly limited but may be circular, polygonal, spiral, concentric or radial.

The chemical mechanical polishing pad of the present invention may have a portion having another function other than the polishing portion. The portion having another function is, for example, a window portion for detecting the end point by using an optical end-point detector. The window portion may be made of a material having a transmittance at a wavelength of 100 to 300 nm of preferably 0.1% or more, more preferably 2% or more, or an integral transmittance at a wavelength of 100 to 300 nm of preferably 0.1% or more, more preferably 2% or more when it is as thick as 2 mm. The material of the window portion is not particularly limited if it has the above optical characteristics but may be the same as the material of the above polishing substrate.

The method of manufacturing the polishing substrate constituting the chemical mechanical polishing pad of the present invention is not particularly limited, and the method of forming a groove(s) and a recess(es) (to be both referred to as "a groove(s) and the like" hereinafter) that the polishing substrate may optionally have is not particularly limited. For example, a composition for a chemical mechanical polishing pad which will become the polishing substrate of the chemical mechanical polishing pad is prepared and molded into a desired form, and a groove(s) and the like are formed in the molded product by cutting. Alternatively, the composition for a chemical mechanical polishing pad is molded by using a metal mold having a pattern which will become the groove(s) and the like, thereby making it possible to form the groove(s) and the like simultaneously with the formation of the polishing substrate.

The method of obtaining the composition for the chemical mechanical polishing pad is not particularly limited. For example, it can be obtained by kneading together required materials including a predetermined organic material by a kneader. Conventionally known kneaders may be employed, such as a roll, kneader, Banbury mixer and extruder (single-screw or double-screw).

The composition for a polishing pad which contains water-soluble particles for obtaining a polishing pad containing the water-soluble particles can be obtained, for example, by kneading together a water-insoluble matrix, water-soluble particles and other additives. In general, they are kneaded together by heating so that they can be easily processed during kneading, and the water-soluble particles are preferably solid at this heating temperature. When the water-soluble particles are solid, they can be dispersed with the above preferred average particle diameter regardless of their compatibility with the water-insoluble matrix. Therefore, the type of the water-soluble particles is preferably selected according to the processing temperature of the water-insoluble matrix in use.

The chemical mechanical polishing pad of the present invention may consist of the above polishing substrate alone or may be a multi-layer pad having a support layer on the non-polishing surface of the above polishing substrate.

The above support layer is a layer for supporting the polishing substrate on the rear surface opposite to the polishing surface. The characteristic properties of this support layer are not particularly limited but preferably softer than the polishing substrate. Since the chemical mechanical polishing pad of the present invention has the soft support layer, even when the polishing substrate is thin, for example, 1.0 mm or less, it can prevent the polishing substrate from rising during polishing or the surface of the polishing layer from curving, thereby making it possible to carry out polishing stably. The hardness of this support layer is preferably 90% or less, more preferably 50 to 90%, most preferably 50 to 80%, particularly preferably 50 to 70% of the hardness of the polishing substrate.

The support layer may be porous (foamed) or non-porous. Further, the plane shape of the support layer is not particularly limited and may be the same or different from that of the polishing layer. The plane shape of the support layer may be circular or polygonal (square or the like). The thickness of the support layer is not particularly limited but preferably 0.1 to 5 mm, more preferably 0.5 to 2 mm.

The material constituting the support layer is not particularly limited but preferably an organic material as it can be molded easily to have a predetermined shape and properties and provide suitable elasticity.

The above chemical mechanical polishing pad of the present invention can suppress the production of a scratch on the polished surface and provides a high-quality polished surface.

The chemical mechanical polishing pad of the present invention is mounted on a commercially available polishing machine so that it can be used in the chemical mechanical polishing step by a known method.

The chemical mechanical polishing pad of the present invention can be used in a wide variety of chemical mechanical polishing steps for the manufacture of a semiconductor device.

The object which can be subjected to chemical mechanical polishing by using the chemical mechanical polishing pad of the present invention is a metal as a wiring material, barrier metal or insulating film. Examples of the above metal include tungsten, aluminum, copper and alloys thereof. Examples of the above barrier metal include tantalum, tantalum nitride, titanium, titanium nitride and tungsten nitride. Examples of the above insulating film include a silicon oxide film (such as a PETEOS film (Plasma Enhanced-TEOS film) formed by a vacuum process such as chemical vapor deposition, HDP film (High Density Plasma Enhanced-TEOS film) and silicon oxide film obtained by thermal CVD), boron phosphorus silicate film (BPSG film) formed by adding small amounts of boron and phosphorus to $SiO_2$, insulating film called FSG (Fluorine-doped silicate glass) obtained by doping $SiO_2$ with fluorine, insulating film called SiON (Silicon oxynitride), silicon nitride film and low-dielectric insulating film.

Examples of the above low-dielectric insulating film include an insulating film made of a polymer obtained by plasma polymerizing a silicon-containing compound such as an alkoxysilane, silane, alkylsilane, arylsilane, siloxane or alkylsiloxane in the presence of oxygen, carbon monoxide, carbon dioxide, nitrogen, argon, $H_2O$, ozone or ammonia, insulating film made of polysiloxane, polysilazane, polyarylene ether, polybenzoxazole, polyimide or silsesquioxane, and silicon oxide-based insulating film having a low dielectric constant.

Although the chemical mechanical polishing pad of the present invention can be used in a wide variety of chemical mechanical polishing steps as described above, it can be particularly advantageously used in the step of forming damascene wiring made of copper. The step of forming damascene wiring made of copper comprises the substep of removing excessive copper from an object to be polished on which copper is deposited as a wiring material (first polishing step), the substep of removing a barrier metal of a portion other than a groove(s) (second polishing step), and the substep of polishing an insulating film portion slightly (third polishing step) after a barrier metal layer is formed in the groove portion(s) of an insulating film in which the groove(s) is/are formed in a wiring portion and a portion other than the groove(s), thereby obtaining flat damascene wiring. The chemical mechanical polishing pad of the present invention may be used in the chemical mechanical polishing step for use in any one of the above first to third polishing substeps.

The term "copper" as hereinabove should be understood as a concept including pure copper and an alloy of copper and aluminum or silicon, which contains 95% or more by mass of copper.

According to the present invention, there are provided a chemical mechanical polishing pad which can suppress the production of a scratch on the polished surface in the chemical mechanical polishing step and can provide a high-quality polished surface and a chemical mechanical polishing process which provides a high-quality polished surface by using the chemical mechanical polishing pad.

EXAMPLES

Example 1

(1) Manufacture of Chemical Mechanical Polishing Pad (1-1) Preparation of Composition for Chemical Mechanical Polishing Pad 72.2 parts by mass of 1,2-polybutadiene (manufactured by JSR Corporation, trade name of JSR RB830) and 27.2 parts by mass of β-cyclodextrin (manufactured by Bio Research Corporation of Yokohama, trade name of Dexy Pearl β-100, average particle diameter of 20 μm) were kneaded together by an extruder set at 160° C. for 2 minutes. Thereafter, 0.45 part by mass (corresponding to 0.25 part by mass in terms of dicumyl peroxide based on 100 parts by mass of 1,2-polybutadiene) of Percumyl D40 (trade name, manufactured by NOF Corporation, containing 40% by mass of dicumyl peroxide) was added to and kneaded with the above kneaded product at 120° C. and 60 rpm for 2 minutes to obtain a pellet of a composition for a chemical mechanical polishing pad.

(1-2) Measurement of Storage Elastic Modulus of Polishing Substrate

This pellet was heated in a metal mold at 170° C. for 18 minutes to be crosslinked so as to obtain a disk-like molded product having a diameter of 600 mm and a thickness of 2.5 mm. Thereafter, this molded product was cut into a strip having a width of 2.5 mm, a length of 30 mm and a thickness of 1.0 mm by a parallel moving cutting machine (SDL-200STT) of Dumbbell Co., Ltd. as a specimen to measure its storage elastic modulus in a tensile mode at 30° C. and 60° C., an initial load of 100 g, a maximum bias of 0.01% and a frequency of 0.2 Hz by using a viscoelasticity measuring instrument (manufactured by Rheometric Scientific Co., Ltd., model of RSAIII). Its storage elastic modulus was 89 MPa at 30° C. and 23 MPa at 60° C., and the ratio of these was 3.9.

(1-3) Preparation of Member for Window Portion 97 parts by mass of 1,2-polybutadiene (manufactured by JSR Corporation, trade name of JSR RB830) and 3 parts by mass of β-cyclodextrin (manufactured by Bio Research Corporation of Yokohama, trade name of Dexy Pearl β-100, average particle diameter of 20 μm) were kneaded together by an extruder set at 160° C. for 2 minutes. Thereafter, 1.19 parts by mass (corresponding to 0.5 part by mass in terms of dicumyl peroxide based on 100 parts by mass of 1,2-polybutadiene) of Percumyl D40 (trade name, manufactured by NOF Corporation, containing 40% by mass of dicumyl peroxide) was added to and kneaded with the above kneaded product at 120° C. and 60 rpm for 2 minutes to obtain a pellet of a composition for a chemical mechanical polishing pad. This pellet was heated in a metal mold at 170° C. for 18 minutes to be crosslinked so as to obtain a disk-like molded product having a diameter of 600 mm and a thickness of 2.4 mm. Further, a punched member for a window portion having a width of 20 mm, a length of 58 mm and a thickness of 2.4 mm was obtained from this molded product by a dumbbell punching machine (model of SDL-200) of Dumbbell Co., Ltd. When the transmittance at a wavelength of 670 nm of this member was measured by an UV absorptiometer (manufactured by Hitachi, Ltd., model of U-2010), it was 40%.

(1-4) Manufacture of Chemical Mechanical Polishing Pad

A disk-like molded product having a diameter of 600 mm and a thickness of 2.5 mm was obtained in the same manner as in the above paragraph (1-2). Thereafter, concentric grooves (having a rectangular sectional form) having a width of 0.5 mm, a pitch of 2.0 mm and a depth of 1.0 mm were formed on the polishing surface of this molded product by using a commercially available cutting machine. Further, a through hole having a width of 21 mm and a length of 59 mm was formed at a position 72 mm away from the center of the molded product. A double-coated tape (manufactured by Sekisui Chemical Co., Ltd., trade name of Double Tack Tape #512) was affixed to the entire surface opposite to the groove formed surface, and the member for a window portion prepared in the above paragraph (1-3) was inserted into the above through hole. Further, this molded product was cut to a diameter of 508 mm along the concentric grooves to obtain a chemical mechanical polishing pad.

(2) Evaluation of Chemical Mechanical Polishing Performance (2-1) Example in which a Wafer having a Pattern Composed of Copper and a Low-Dielectric Insulating Film is Polished The chemical mechanical polishing pad produced as described in the above paragraph (1) was placed on the platen of the Mirra/Mesa chemical mechanical polishing machine equipped with an optical end-point detector (manufactured by Applied Materials Inc.) to carry out the chemical mechanical polishing of Sematech800BDM001 (trade name, manufactured by International SEMATECH Inc., a test wafer obtained by forming a silicon carbide layer on a silicon substrate, forming the Black Diamond low-dielectric insulating film (trade name, manufactured by Applied Materials Co., Ltd.) on a portion other than a wiring portion of the layer and depositing tantalum as a barrier metal and copper as a wiring material on the low-dielectric insulating film in the mentioned order) in two stages under the following conditions.

The polishing time in the first-stage polishing was set to 1.2 times the time from the start of polishing to the time when reflectance changed (that is, the barrier metal was exposed) by monitoring the reflectance of a laser beam with the optical end-point detector of the chemical mechanical polishing machine. The polishing time in the first-stage polishing of this example was 150 sec.

Conditions of First-Stage Polishing

Aqueous dispersion for chemical mechanical polishing: a mixture of iCue5003 (trade name, manufactured by Cabot Microelectronics Co., Ltd., containing silica as abrasive grains) and 30 mass % hydrogen peroxide water in a volume ratio of 11:1 supply rate of aqueous dispersion: 300 ml/min

Revolution of platen: 120 rpm

Revolution of head: 108 rpm

Head pressure

Retainer ring pressure: 5.5 psi

Membrane pressure: 4.0 psi

Inner tube pressure: 3.0 psi

Condition of Second-Stage Polishing

Aqueous dispersion for chemical mechanical polishing: dispersion prepared by adding 1% by mass of 30 mass % hydrogen peroxide water to CMS-8301 (trade name, manufactured by JSR Corporation)

Supply rate of aqueous dispersion: 200 ml/min

Revolution of platen: 60 rpm

Revolution of head: 54 rpm

Head pressure

Retainer ring pressure: 5.5 psi

Membrane pressure: 3.0 psi

Inner tube pressure: 0.0 psi

Polishing time: 100 sec

When the number of scratches on the entire polished surface of the wafer after polishing was measured by using a wafer defect inspection device (manufactured by KLA-Tencor Co., Ltd., trade name of KLA2351), there were 3 scratches on the copper writing and 3 scratches on the low-dielectric insulating film.

KLA2351 measurement conditions

Spectrum mode: Visible

Pixel size: 0.62 μm

Threshold: 50

Merge: 100

Size sieve: 1 $\mu m^2$ (3) Evaluation of Peeling at Periphery of Low-Dielectric Insulating Film (When the Low-Dielectric Insulating Film is the Surface to be Polished)

(3-1) Manufacture of Low-Dielectric Insulating Film (i) Preparation of Polysiloxane Sol A solution comprising 101.5 g of methyl trimethoxysilane, 276.8 g of methyl methoxypropionate and 9.7 g of tetraisopropoxy titanium/ethyl acetoacetate complex was heated at 60° C. 112.3 g of a mixture of γ-butyrolactone and water (weight ratio of 4.58:1) was added dropwise to this solution over 1 hour. After the addition of this mixture, the mixture was reacted at 60° C. for 1 hour to obtain a polysiloxane sol containing 15% by mass of polysiloxane.

(ii) Production of Polystyrene Particles 100 parts by mass of styrene, 2 parts by mass of an azo-based polymerization initiator (manufactured by Wako Pure Chemical Industries, Ltd., trade name of V60), 0.5 part by mass of potassium dodecylbenzenesulfonate and 400 parts by mass of ion exchange water were injected into a flask, heated at 70° C. in a nitrogen gas atmosphere under agitation and kept stirred at that temperature for 6 hours. The reaction mixture was filtered and dried to obtain polystyrene particles having a number average particle diameter of 150 nm.

(iii) Production of Low-Dielectric Insulating Film 15 g of the polysiloxane sol obtained in (i) and 1 g of the polystyrene particles obtained in (ii) were mixed together, and the obtained mixture was applied to a 8 inch-diameter silicon substrate having a thermal oxide film (manufactured by Asahibi Sangyo Co., Ltd.) by spin coating and heated at 80° C. for 5 minutes to form a coating film having a thickness of 1.39 μm. Thereafter, the coating film was heated at 200° C. for 5 minutes and then at 340° C., 360° C. and 380° C. and a pressure of 5 torr for 30 minutes each and further at 450° C. for 1 hour to form an achromatic transparent film (thickness of 2,000 Å).

When the section of this film was observed through a scanning electron microscope, it was confirmed that pores were formed. The film had a dielectric constant of 1.98, an elastic modulus of 3 GPa and a porosity of 15% by volume.

(3-2) Polishing of Low-Dielectric Insulating Film

Chemical mechanical polishing was carried out on the low-dielectric insulating film manufactured as described above as the surface to be polished under the following conditions. The following polishing test was an acceleration test under conditions where the peeling of the low-dielectric insulating film would readily occur.

Chemical Mechanical Polishing Machine: Mirra/Mesa (Manufactured by Applied Materials Inc.)

Type of aqueous dispersion for chemical mechanical polishing: CMS-8301 (trade name, manufactured by JSR Corporation, containing colloidal silica as abrasive grains) supply rate of aqueous dispersion for chemical mechanical polishing: 100 ml/min
Revolution of platen: 60 rpm
Revolution of head: 54 rpm Head pressure
Retainer ring pressure: 6.5 psi
Membrane pressure: 5.0 psi
Inner tube pressure: 0.0 psi Polishing time: 15 sec The existence of the peeling at the periphery of the low-dielectric insulating film as the polished surface was observed through an optical microscope.

When the peeling of the low-dielectric insulating film occurred, the maximum value of a distance where the peeling occurred from the periphery of the insulating film is shown in Table 3. The maximum value of "0" indicates that the peeling did not occur.

(4) Evaluation of Peeling at the Periphery of Low-Dielectric Insulating Film (When the Metal Film is the Surface to be Polished and the Low-Dielectric Insulating Film is an Underlying Layer)

(4-1) Evaluation of Chemical Mechanical Polishing Performance

Chemical mechanical polishing was made on ATDF800LKD003 (trade name, manufactured by Advanced Technology Development Facility Inc., a test wafer obtained by forming a silicon carbide layer on a silicon substrate, forming the LKD5109 low-dielectric insulating film (trade name, manufactured by JSR Corporation) on a portion other than a wiring portion of the layer and depositing tantalum as a barrier metal and copper as a wiring material on the low-dielectric insulating film in the mentioned order) under the following conditions. The following polishing test was an acceleration test under conditions where the peeling of the low-dielectric insulating film would readily occur.

Chemical Mechanical Polishing Machine: Mirra/Mesa (Manufactured by Applied Materials Inc.)

Aqueous dispersion for chemical mechanical polishing: a mixture of iCue5003 (trade name, manufactured by Cabot Microelectronics Co., Ltd., containing silica as abrasive grains) and 30 mass % hydrogen peroxide water in a volume ratio of 11:1
supply rate of aqueous dispersion: 100 ml/min
Revolution of platen: 120 rpm
Revolution of head: 108 rpm Head pressure
Retainer ring pressure: 6.5 psi
Membrane pressure: 5.0 psi
Inner tube pressure: 4.0 psi Polishing time: 15 sec As for the polished surface after polishing, the peeling at the periphery of the underlying low-dielectric insulating film was checked by using an optical microscope.

When the peeling of the low-dielectric insulating film occurred, the maximum value of a distance where the peeling occurred from the periphery of the insulating film is shown in Table 3.

Examples 2 to 10

The procedure of Example 1 was repeated except that the types and amounts of raw materials in (1-1) preparation of composition for chemical mechanical polishing pad were changed as shown in Table 1. The evaluation results are shown in Tables 2 and 3.

Abbreviations in Table 1 indicate the following substances. The numerical values in Table 1 are parts by mass.

RB830: 1,2-polybutadiene (manufactured by JSR Corporation, trade name of JSR RB830)

RB810: 1,2-polybutadiene (manufactured by JSR Corporation, trade name of JSR RB810)

TR2827: styrene-butadiene block copolymer (manufactured by Kraton JSR Elastomers KK, trade name of TR2827)

HF55: polystyrene (manufactured by PS Japan Co., Ltd., trade name of HF55)

β-CD: β-cyclodextrin (manufactured by Bio Research Corporation of Yokohama, trade name of Dexy Pearl β-40, average particle diameter of 20 μm)

D40: manufactured by NOF Corporation, trade name of Percumyl D40, containing 40% by mass of dicumyl peroxide PHR: amount of an organic peroxide based on 100 parts by mass of the raw material of the water-insoluble member (parts by mass in terms of a pure organic peroxide product)

Comparative Example 1

Chemical mechanical polishing and evaluations were carried out in the same manner as in Example 1 except that the IC1000 manufactured by Rodel & Nitta Co., Ltd. was used as a chemical mechanical polishing pad. The results are shown in Tables 2 and 3. Since the IC1000 had no window portion for transmitting the detection light of the optical end-point detector and the optical end-point detector could not be used, the first-stage polishing time was set to 150 sec in accordance with Example 1.

TABLE 1

| | Material of water-insoluble member | | | | water-soluble particles | organic peroxide | |
|---|---|---|---|---|---|---|---|
| | RB830 | RB810 | TR2827 | HF55 | β-CD | D40 | PHR |
| Example 1 | 72.2 | 0 | 0 | 0 | 27.2 | 0.45 | 0.25 |
| Example 2 | 72.2 | 0 | 0 | 0 | 27.2 | 0.90 | 0.50 |
| Example 3 | 97 | 0 | 0 | 0 | 3 | 1.19 | 0.50 |
| Example 4 | 57.8 | 0 | 14.4 | 0 | 27.2 | 0.90 | 0.50 |

TABLE 1-continued

| | Material of water-insoluble member | | | | water-soluble particles | organic peroxide | |
|---|---|---|---|---|---|---|---|
| | RB830 | RB810 | TR2827 | HF55 | β-CD | D40 | PHR |
| Example 5 | 57.8 | 0 | 0 | 14.4 | 27.2 | 0.45 | 0.25 |
| Example 6 | 0 | 72.2 | 0 | 0 | 27.2 | 0.45 | 0.25 |
| Example 7 | 0 | 72.2 | 0 | 0 | 27.2 | 0.90 | 0.50 |
| Example 8 | 0 | 97 | 0 | 0 | 3 | 1.19 | 0.50 |
| Example 9 | 0 | 57.8 | 14.4 | 0 | 27.2 | 0.90 | 0.50 |
| Example 10 | 0 | 57.8 | 0 | 14.4 | 27.2 | 0.45 | 0.25 |

TABLE 2

| | Storage elastic modulus | | | chemical mechanical polishing results | | |
|---|---|---|---|---|---|---|
| | | | | First-stage | scratch (number of scratches) | |
| | E'(30° C.) (MPa) | E'(60° C.) (MPa) | E'(30° C.)/ E'(60° C.) | polishing time (seconds) | on copper wiring | on insulating film |
| Example 1 | 89 | 23 | 3.9 | 150 | 3 | 3 |
| Example 2 | 110 | 14 | 7.9 | 144 | 19 | 37 |
| Example 3 | 53 | 7 | 7.6 | 155 | 5 | 5 |
| Example 4 | 69 | 13 | 5.3 | 148 | 5 | 4 |
| Example 5 | 99 | 13 | 7.6 | 146 | 8 | 3 |
| Example 6 | 25 | 8 | 3.1 | 155 | 2 | 0 |
| Example 7 | 54 | 11 | 4.9 | 148 | 10 | 6 |
| Example 8 | 19 | 3 | 6.3 | 159 | 2 | 0 |
| Example 9 | 21 | 6 | 3.5 | 155 | 3 | 0 |
| Example 10 | 68 | 12 | 5.7 | 152 | 5 | 1 |
| Comparative Example 1 | 419 | 260 | 1.6 | 150 | 2004 | 1992 |

TABLE 3

| | Peeling of low-dielectric insulating film | |
|---|---|---|
| | Polished surface: low-dielectric insulating film Distance from periphery (mm) | polished surface: copper film distance from periphery (mm) |
| Example 1 | 0 | 0 |
| Example 2 | 5 | 4 |
| Example 3 | 0 | 0 |
| Example 4 | 0 | 0 |
| Example 5 | 2 | 0 |
| Example 6 | 0 | 0 |
| Example 7 | 0 | 0 |
| Example 8 | 0 | 0 |
| Example 9 | 0 | 0 |
| Example 10 | 0 | 0 |
| Comparative Example 1 | 43 | 20 |

What is claimed is:

1. A chemical mechanical polishing pad which has a storage elastic modulus E'(30° C.) at 30° C. of 99 MPa or less and an (E'(30° C.)/E'(60° C.)) ratio of the storage elastic modulus E'(30° C.) at 30° C. to the storage elastic modulus E'(60° C.) at 60° C. of 2.5 or more when the storage elastic moduli of a polishing substrate at 30° C. and 60° C. are measured under the following conditions:

initial load: 100 g maximum bias: 0.01% frequency: 0.2 Hz wherein the polishing substrate comprises a water-insoluble member and water-soluble particles dispersed in the water-insoluble member, and the water-insoluble member comprises a partially or wholly crosslinked organic material which has been obtained by crosslinking an organic material with 0.01 to 0.6 part by mass of a crosslinking agent based on 100 parts by weight of the organic material.

2. A chemical mechanical polishing process comprising chemical mechanical polishing carried out using the chemical mechanical polishing pad of claim 1.

3. The chemical mechanical polishing process according to claim 2, wherein the chemical mechanical polishing is used in the forming of damascene wiring made of copper.

4. The chemical mechanical polishing pad according to claim 1, wherein said water-insoluble member comprises a partially crosslinked organic material.

5. The chemical mechanical polishing pad according to claim 1, wherein said water-insoluble member comprises a wholly crosslinked organic material.

6. The chemical mechanical polishing pad according to claim 1, which has a storage elastic modulus E'(30° C.) at 30° C. of 30-99 MPa.

7. The chemical mechanical polishing pad according to claim 1, wherein the amount of water-soluble particles (B) is 27.2—40% by volume based on the total volume of the water-insoluble member (A) and the water-soluble particles (B).

8. The chemical mechanical polishing pad according to claim 1, which has a storage elastic modulus E'(30° C.) at 30° C. of 30-89 MPa.

9. The chemical mechanical polishing pad according to claim 1, which has a storage elastic modulus E'(30° C.) at 30° C. of 30-69 MPa.

10. The chemical mechanical polishing pad according to claim 1, which has a storage elastic modulus E'(30° C.) at 30° C. of 30-54 MPa.

11. The chemical mechanical polishing pad according to claim 4, which has a storage elastic modulus E'(30° C.) at 30° C. of 30-99 MPa.

12. The chemical mechanical polishing pad according to claim 4, wherein the amount of water-soluble particles (B) is 27.2—40% by volume based on the total volume of the water-insoluble member (A) and the water-soluble particles (B).

13. The chemical mechanical polishing pad according to claim 4, which has a storage elastic modulus E'(30° C.) at 30° C. of 30-89 MPa.

14. The chemical mechanical polishing pad according to claim 4, which has a storage elastic modulus E'(30° C.) at 30° C. of 30-69 MPa.

15. The chemical mechanical polishing pad according to claim 4, which has a storage elastic modulus E'(30° C.) at 30° C. of 30-54 MPa.

16. The chemical mechanical polishing pad according to claim 5, which has a storage elastic modulus E'(30° C.) at 30° C. of 30-99 MPa.

17. The chemical mechanical polishing pad according to claim 5, wherein the amount of water-soluble particles (B) is 27.2—40% by volume based on the total volume of the water-insoluble member (A) and the water-soluble particles (B).

18. The chemical mechanical polishing pad according to claim 5, which has a storage elastic modulus E'(30° C.) at 30° C. of 30-89 MPa.

19. The chemical mechanical polishing pad according to claim 5, which has a storage elastic modulus E'(30° C.) at 30° C. of 30-69 MPa.

20. The chemical mechanical polishing pad according to claim 5, which has a storage elastic modulus E'(30° C.) at 30° C. of 30-54 MPa.

* * * * *